US011613791B2

(12) United States Patent
Beier et al.

(10) Patent No.: US 11,613,791 B2
(45) Date of Patent: Mar. 28, 2023

(54) METHOD FOR COATING STEEL SHEETS OR STEEL STRIPS AND METHOD FOR PRODUCING PRESS-HARDENED COMPONENTS THEREFROM

(71) Applicant: Salzgitter Flachstahl GmbH, Salzgitter (DE)

(72) Inventors: Frank Beier, Duisburg (DE); Kerstin Körner, Duisburg (DE); Marc Debeaux, Duisburg (DE)

(73) Assignee: Salzgitter Flachstahl GmbH, Salzgitter (DE)

( * ) Notice: Subject to any disclaimer, the term of this patent is extended or adjusted under 35 U.S.C. 154(b) by 734 days.

(21) Appl. No.: 16/487,004

(22) PCT Filed: Feb. 14, 2018

(86) PCT No.: PCT/EP2018/053702
§ 371 (c)(1),
(2) Date: Aug. 19, 2019

(87) PCT Pub. No.: WO2018/153755
PCT Pub. Date: Aug. 30, 2018

(65) Prior Publication Data

US 2020/0232057 A1 Jul. 23, 2020

(30) Foreign Application Priority Data

Feb. 21, 2017 (DE) ..... 10 2017 103 492.7

(51) Int. Cl.
*C23C 2/12* (2006.01)
*C21D 9/46* (2006.01)
(Continued)

(52) U.S. Cl.
CPC ..... *C21D 9/46* (2013.01); *C21D 1/673* (2013.01); *C21D 6/005* (2013.01); *C22C 38/04* (2013.01);
(Continued)

(58) Field of Classification Search
CPC ..... C25D 3/20; C25D 3/562
(Continued)

(56) References Cited

U.S. PATENT DOCUMENTS 6,564,604 B2 5/2003 Kefferstein et al.
2012/0085466 A1* 4/2012 Lupp ..... C23C 2/12 148/400
2019/0040513 A1 2/2019 Koll et al.

FOREIGN PATENT DOCUMENTS

DE 601 19 826 12/2006
DE 699 33 751 10/2007
(Continued)

OTHER PUBLICATIONS

Russian Search Report dated May 21, 2020 with respect to counterpart Chinese patent application 2019125662/05 (050287).
(Continued)

*Primary Examiner* — Lois L Zheng
(74) *Attorney, Agent, or Firm* — Henry M. Feiereisen LLC

(57) ABSTRACT

The invention relates to a method for coating a steel sheet or steel strip to which an aluminium-based coating is applied in a dip-coating process and the surface of the coating is freed of a naturally occurring aluminium oxide layer. In order to provide a low-cost method for coating steel sheets or steel strips that makes the steel sheets or steel strips outstandingly suitable for the production of components by means of press hardening and for the further processing thereof, it is proposed that transition metals or transition metal compounds
(Continued)

are subsequently deposited on the freed surface of the coating to form a top layer. The invention also relates to a method for producing press-hardened components from the aforementioned steel sheets or steel strips with an aluminium-based coating.

20 Claims, 2 Drawing Sheets

(51) Int. Cl.

| | |
|---|---|
| ***C21D 1/673*** | (2006.01) |
| ***C21D 6/00*** | (2006.01) |
| ***C22C 38/04*** | (2006.01) |
| ***C23C 2/40*** | (2006.01) |
| ***C23F 17/00*** | (2006.01) |
| ***C25D 5/44*** | (2006.01) |
| ***C25D 5/50*** | (2006.01) |
| ***C25D 7/06*** | (2006.01) |
| *C25D 3/20* | (2006.01) |

(52) U.S. Cl.
CPC ..... *C23C 2/12* (2013.01); *C23C 2/40* (2013.01); *C23F 17/00* (2013.01); *C25D 5/44* (2013.01); *C25D 5/50* (2013.01); *C25D 7/0614* (2013.01)

(58) Field of Classification Search
USPC ..... 148/287
See application file for complete search history.

(56) References Cited

FOREIGN PATENT DOCUMENTS

| | | |
|---|---|---|
| DE | 102007048504 | 4/2009 |
| DE | 102009007909 | 8/2010 |
| DE | 102015210459 | 12/2016 |
| DE | 102016102504 | 8/2017 |
| EP | 2 045 360 | 4/2009 |
| RU | 2466210 C2 | 11/2012 |
| WO | WO 2014/090561 | 6/2014 |

OTHER PUBLICATIONS

Translation of Russian Search Report dated May 21, 2020 with respect to counterpart Chinese patent application 2019125662/05 (050287).
International Search Report dated Jun. 5, 2018 by the European Patent Office in International Application PCT/EP2018/053702.

* cited by examiner

METHOD FOR COATING STEEL SHEETS OR STEEL STRIPS AND METHOD FOR PRODUCING PRESS-HARDENED COMPONENTS THEREFROM

CROSS-REFERENCES TO RELATED APPLICATIONS

This application is the U.S. National Stage of International Application No. PCT/IEP2018/053702, filed Feb. 14, 2018, which designated the United States and has been published as International Publication No. WO 2018/153755 A1 and which claims the priority of German Patent Application, Serial No. 10 2017 103 492.7, filed Feb. 21, 2017, pursuant to 35 U.S.C. 119(a)-(d).

BACKGROUND OF THE INVENTION

The invention relates to a method for coating a steel sheet or steel strip, to which an aluminium-based coat is applied in a hot-dipping process and the surface of the coat is freed of a naturally occurring aluminium oxide layer. Furthermore, the invention relates to a method for producing press-hardened components consisting of these steel sheets or steel strips with an aluminium-based coating.

Aluminium-based coats are understood hereinafter to be metallic coats, in which aluminium is the main constituent in mass percent. Examples of possible aluminium-based coats are aluminium, aluminium-silicon (AS), aluminium-zinc-silicon (AZ), and the same coats with admixtures of additional elements, such as e.g. magnesium, manganese, titanium and rare earths.

It is known that hot-formed steel sheets are being used with increasing frequency in particular in automotive engineering. By means of the process which is defined as press-hardening, it is possible to produce high-strength components which are used predominantly in the region of the bodywork. Press-hardening can fundamentally be carried out by means of two different method variations, namely by means of the direct or indirect method. Whereas the process steps of forming and hardening are performed separately from one another in the indirect methods, they take place together in one tool in the direct method. However, only the direct method will be considered hereinafter.

In the direct method, a steel sheet plate is heated above the so-called austenitization temperature (Ac3), the thus heated plate is then transferred to a forming tool and formed in a single-stage formation step to make the finished component and in this case is cooled by the cooled forming tool simultaneously at a rate above the critical cooling rate of the steel so that a hardened component is produced.

Known hot-formable steels for this area of application are e.g. the manganese-boron steel "22MnB5" and latterly also air-hardenable steels according to European patent EP 2 449 138 B1.

In addition to uncoated steel sheets, steel sheets comprising scaling protection for press-hardening are also used in the automotive industry. The advantages here are that, in addition to the increased corrosion resistance of the finished component, the plates or components do not become scaled in the furnace, whereby wearing of the pressing tools by flaked-off scales is reduced and the components do not have to undergo costly blasting prior to further processing.

Currently, the following (alloy) coatings which are applied by hot-dipping are known for press-hardening: aluminium-silicon (AS), zinc-aluminium (Z), zinc-aluminium-iron (ZF/galvannealed), zinc-magnesium-aluminium-iron (ZM) and electrolytically deposited coatings of zinc-nickel or zinc, wherein the latter is converted to an iron-zinc alloy layer prior to hot-forming. These corrosion protection coatings are conventionally applied to the hot or cold strip in continuous feed-through processes.

The production of components by means of quenching of pre-products consisting of press-hardenable steels by hot-forming in a forming tool is known from German patent DE 601 19 826 T2, In this case, a sheet plate previously heated above the austenitization temperature to 800-1200° C. and possibly provided with a metallic coat of zinc or on the basis of zinc is formed in an occasionally cooled tool by hot-forming to produce a component, wherein during forming, by reason of rapid heat extraction, the sheet or component in the forming tool undergoes quench-hardening (press-hardening) and obtains the required strength properties owing to the resulting martensitic hardness structure.

The production of components by means of quenching of pre-products which are coated with an aluminium alloy and consist of press-hardenable steels by hot-forming in a forming tool is known from German patent DE 699 33 751 T2. In this case, a sheet which is coated with an aluminium alloy is heated to above 700° C. prior to forming, wherein an intermetallic alloyed compound on the basis of iron, aluminium and silicon is produced on the surface and subsequently the sheet is formed and cools at a rate above the critical cooling rate.

German laid-open document DE 10 2016 102 504 A1 discloses an aluminium-based coating for steel sheets and strips and a method for the production thereof. The coating comprises an aluminium-based coat which is applied in a hot-dipping process. Subsequently, a layer which is produced by atmospheric oxidation and is arbitrarily formed is removed in an upstream alkaline pre-treatment with occasionally subsequent add deoxidation. In turn, a cover layer is applied to the coat freed of the arbitrarily formed layer, said cover layer containing aluminium oxide and/or aluminium hydroxide and being produced by means of anodic oxidation, plasma oxidation or hot water treatment. The average thickness of the cover layer is less than 4 μm and more than 0.1 μm.

Laid-open document EP 2 045 360 A1 discloses a method for producing a steel component which is coated with an aluminium coat which subsequently is also provided with a zinc coat. The aluminium coat contains at least 85 wt. % Al and optionally up to 15 wt. % Si; the zinc coat contains at least 90 wt. % Zn. Between aluminium and zinc coating, it is advantageously possible to perform deoxidation of the flat steel product provided with the aluminium coat in order to improve the surface roughness of the aluminium coat.

German laid-open document DE 10 2009 007 909 A1 also discloses a method for producing a steel component which is provided quasi with an aluminium coat and subsequently with an aluminium coat. The flat steel product provided with the aluminium coat and the aluminium coat is additionally coated with a cover layer which contains as a main constituent at least one metallic salt of phosphoric acid. Possible metals for metal phosphate formation are inter alia Fe, Mn, Ti, Co and V, wherein from this group only Mn is described as being particularly advantageous. Between the individual coating steps, the layer to be coated or the flat steel product can be cleaned in each case.

The advantage of the aluminium-based coats resides in the fact that, in addition to a larger process window (e.g. in terms of the heating parameters), the finished components do not have to be subjected to blasting prior to further processing. Furthermore, in the case of aluminium-based coats compared with zinc-based coats there is no risk of liquid metal embrittlement and micro-cracks cannot form in the near-surface substrate region on the former austenite grain boundaries which, at depths greater than 10 μm, can have a negative effect on the fatigue strength.

However, a disadvantage in the use of aluminium-based coats, e.g. consisting of aluminium-silicon (AS), is the insufficient lacquering-suitability of the formed component in cathodic dip coating (CDC), typical for automobiles, when too short a heating time has been used for press-hardening. In the case of short heating times, the CD-coated substrate has insufficient corrosion resistance.

In contrast to the zinc-based coats, aluminium-based coats cannot phosphatise or cannot phosphatise sufficiently, and therefore no improvement in the corrosion resistance can be achieved by the phosphatising step. For these reasons, up to now when processing plates with aluminium-based coats by means of press-hardening minimum heating times of the plate must be maintained, whereby the coat is thoroughly alloyed with iron and a surface is formed which effects sufficient corrosion resistance of the coated component.

However, thoroughly alloying the coat with iron and forming a corrosion-resistant surface require a correspondingly long dwell time in the typically used roller hearth furnace, thereby requiring long furnaces in order to permit adequate cycle times. The economic feasibility of the press-form-hardening process is thus reduced. However, longer furnaces are more expensive to purchase and to operate and also require a very large amount of space. The minimum dwell time is thus determined by the coat and not by the base material for which it would be merely necessary to achieve the required austenitization temperature. In addition, the corrosion resistance is reduced by the greater alloying with iron since the aluminium content in the ahoy layer decreases during the furnace dwell time and the iron content increases.

A further disadvantage of known AS coats is that with very short annealing times, i.e. if the coat is not thoroughly alloyed with the base material, the welding capability in the resistance spot welding process (RSW) of the press-form-hardened component is extremely poor. This is expressed e.g. in only a very small welding area. The cause for this is inter alia a very low transition resistance with short annealing times.

Laid-open document DE 10 2015 210 459 A1 discloses a method for hot-forming a steel component which is heated in a heat treatment step in a region of complete or partial austenitization, and the heated steel component is both hot-formed and quench-hardened in a forming step, wherein the heat treatment step is preceded in terms of process technology by a first pre-treatment step, in which the steel component is provided with a corrosion-resistant protective layer in order to protect against scaling in the heat treatment step. Prior to performing the heat treatment step, surface oxidation is effected in a second pre-treatment step, wherein an inert, corrosion-resistant oxidation layer is formed on the scale protection layer, by means of which abrasive tool wear is reduced in the forming step. The surface oxidation can be effected in terms of process technology e.g. by means of pickling passivation.

The disadvantage of the prior art described therein is considered to be, inter alia, that a rough, hard surface structure of the steel component is produced by the aluminium-silicon coating, which results in significant tool wear during press-hardening. By means of the additional oxidation layer, the roughness of the metal surface of the steel component is to be reduced, thus reducing the abrasive tool wear in the forming step.

However, in this case it is disadvantageous that by virtue of surface oxidation prior to the heat treatment caused by the reduction in surface roughness, the lacquer-bonding on the press-form-hardened component and the welding capability are not improved. Moreover, the additional step of surface oxidation is time-consuming and energy-intensive and thus increases the production costs significantly.

Therefore, the object of the invention is to provide a cost-effective method for coating steel sheets or steel strips which makes the steel sheets or steel strips highly suitable for producing components by means of press-hardening and the further processing thereof. In particular, the furnace dwell time is to be reduced whilst still ensuring good RS welding capability and corrosion resistance on the press-form-hardened component after lacquering. Furthermore, a method for producing press-hardened components consisting of such steel sheets or steel strips is to be provided.

SUMMARY OF THE INVENTION

The teaching of the invention includes coating a steel sheet or steel strip, to which an aluminium-based coat is applied in the hot-dipping process, and freeing the surface of the coat of a naturally occurring aluminium oxide layer, characterised in that transition metals or transition metal compounds are subsequently deposited on the freed surface of the coat in order to form a top layer. The previously used term "freed" is to be understood, in terms of what is technically possible, to mean freed of the naturally occurring aluminium oxide layer.

In this case, the top layer is preferably a planar deposit. A full-surface top layer or a not necessarily covering top layer can be present accordingly. The covering top layer can be mesh-like with an ordered or disordered structure or distribution which is then a layer consisting of punctiform top layers and flaws.

Preferably, a top layer is deposited having a layer weight—based on iron—in the range of 7 to 25 $mg/m^2$, preferably 10 to 15 $mg/m^2$.

Furthermore, the teaching of the invention includes a method for producing press-hardened components consisting of steel sheets or steel strips having an aluminium-based coating, wherein the steel sheets or steel strips treated in accordance with the invention are heated at least in regions to a temperature above Ac3 with the aim of hardening, are subsequently formed at this temperature and thereafter are cooled, with the aim of hardening, at a rate which is above the critical cooling rate at least in regions.

It is known that pure $Al_2O_3$ has an almost optimum Pilling-Bedworth ratio which facilitates the formation of highly effective passive layers. Extensive investigations have shown that the aluminium oxide layers formed in particular during the heat treatment in the course of press-form-hardening of untreated AS coats thus remain extremely thin at generally less than 10 nm and therefore are ineffective in relation to the required improvement in resistance spot welding capability and corrosion resistance.

In an advantageous manner, an aluminium oxide layer having mixed oxides of the metals and/or the compounds thereof is formed on the coat with the applied metals and/or the compounds thereof when exposed to an oxygen atmosphere or when exposed to steam. Surprisingly, investigations have demonstrated that by removing the naturally occurring oxide layer of an AS coat, followed by the deposition of specific metals or the compounds thereof (preferably Fe and its compounds) which with $Al_2O_3$ can form mixed oxides (e.g. corundum, eskolaite, haematite, karelianite, tistarite, ilmenite, perowskite and/or spine's), the renewed formation of a thin aluminium oxide layer is prevented before and during the heat treatment. Preferably, the aluminium oxide layer is formed with the mixed oxides in a furnace at a temperature >750° C., preferably 850 to 950° C., and a furnace dwell time >90 s, preferably 120 to 180 s.

Instead, an aluminium-rich oxide layer is formed which is doped with cations of the previously deposited substances. These cations suppress the above-described self-limitation of the oxide layer growth and thus permit the growth of substantially thicker aluminium oxide layers during the heat treatment, wherein oxide Dyer thicknesses of over 80 nm can be achieved which, in comparison with thinner aluminium oxide layers, produce a considerably better resistance spot welding capability and better corrosion behaviour in the CD-coated state.

The core of the invention thus resides in the fact that the Al-based metallic coat is chemically treated in particular before the heat treatment such that it is freed of its naturally occurring oxide layer, and specific metals or the compounds thereof which with $Al_2O_3$ can form mixed oxides are deposited on the surface of the coat. They prevent the formation of a pure aluminium oxide layer during the heat treatment prior to press-hardening. Instead, the deposited substances are partially or completely incorporated into the newly forming oxide layer.

By means of this doping with metal or transition metal cations, the oxide Dyer grows during the course of the heat treatment to very much larger thicknesses (>80 nm) than in the case of untreated Al-based coats (<10 nm), Self-limitation of the aluminium oxide growth is avoided.

In contrast to that described in laid-open document DE 10 2015 210 459 A1, the modification of the AS surface—which improves properties in the core—specifically the creation or formation of a thick aluminium oxide layer, is not completed prior to the heat treatment but instead is achieved in situ, during the course of the heat treatment for press-hardening. In this case, the property-determining, thick aluminium oxide layer grows only during the course of the heat treatment in the furnace.

The technical advantage is that the in situ production of the oxide layer saves resources and energy and can be implemented in a highly efficient manner by applying simple and existing installation engineering.

In the method in accordance with the invention, very thick oxide layers of up to 250 nm are produced with the furnace dwell times described in Table 1 at a furnace temperature of 950° C. Components produced in accordance with the invention have the large welding areas described in Table 2 in resistance spot welding and very good corrosion resistance in the CD-coated state in Table 3 when tested according to the Volkswagen PV1210 corrosion change test.

The treatment in accordance with the invention consists of applying transition metals or transition metal compounds e.g. from the group of titanium, vanadium, chromium, iron and manganese and/or the compounds thereof, preferably almost completely iron and/or the compounds thereof, to the Al-based metallic coat by means of a chemical deposition procedure, preferably in a wet-chemical process. This consists at least of applying a solution of compounds of the elements stated above which react with the Al-based metallic coat in an external current-free reaction. The term "external current-free" is used hi terms of non-electrolytically, Preferably, chemical deposition is effected by means of a spraying, dipping or rolling application. Also, provision is preferably made that the removal of the atmospherically occurring, natural oxide layer and the chemical deposition are effected in a single process step. For this purpose, the two treatment steps can be performed in a continuously operating coating installation which is located downstream of a hot-dip coating installation or is separate from the hot-dip coating installation.

Preferably, this treatment is performed in the presence of compounds of other metals, e.g. from the group of cobalt, molybdenum and tungsten and/or the compounds thereof. For example, molybdates, tungstates or cobalt nitrate accelerate the deposition of the iron significantly but are themselves deposited only to a small extent, thus making the method in accordance with the invention even more efficient. However, iron or its compounds are preferably deposited because iron or iron compounds are readily available, inexpensive and non-toxic. Moreover, iron is already contained in the base material.

The removal of the naturally occurring oxide layer and the deposition of the substances in accordance with the invention can advantageously also be performed simultaneously in a single wet-chemical step using alkaline media. Such deposition processes can be performed in continuously operating installations at strip speeds of up to 120 m/min or more. The required active substance quantity can be less than 100 mg/m$^2$.

In accordance with the invention, the metals and the chemical compounds thereof can also be applied by electrolytic deposition. To this end, the naturally occurring oxide layer of the Al-based coat (e.g. AS) is removed with alkaline deoxidation, rinsed and the metal or the chemical compound consisting of an electrolyte is electrochemically deposited. In the case of electrochemical post-treatment in aqueous media, an electrolyte temperature of 20° C. to 85° C. is advantageously maintained and current densities between 0.05 and 150 A/dm$^2$ are applied. When using ionic liquids for metal deposition, electrolyte temperatures of greater than or equal to 85° C. can also be applied. The treatment of the metal strip can be performed in a continuous strip installation at process speeds of up to 120 m/min or more.

Moreover, by means of the inventive treatment of the aluminium-based coating, consisting of the removal of the initially occurring natural oxide layer and subsequent treatment of the AS surface with metal-containing solutions, it is possible during subsequent further processing of the steel sheet by hot-forming or press-hardening to achieve a reduction in the minimum dwell time in the furnace, which increases productivity significantly. In the case of untreated AS coats, the minimum dwell time in the furnace for the growing of the oxide layer is determined by the requirement of welding capability in the resistance spot welding procedure and of corrosion resistance in the CD-coated state.

The investigations have revealed that starting from a layer weight of ca. 10 mg/m$^2$ of active substance applied to the AS surface, based on the lead element iron, a considerable reduction in the minimum retention time in the heat treatment is shown. Specifically, a 1.2 mm thick substrate of a steel alloy (22MnB5) suitable for press-form-hardening and having an AS coat (150 g/m$^2$) with an iron top layer of ca. 15 mg/m$^2$ had properties, even after a furnace dwell time of 3 min at a furnace temperature of 950° C. which are achieved only after 6 min furnace dwell time in untreated samples of the same sheet thickness. The required furnace dwell time could thus be halved in comparison with the standard process.

BRIEF DESCRIPTION OF THE DRAWING

Other features and advantages of the present invention will become apparent upon reading the following description with reference to the accompanying drawing, in which.

DETAILED DESCRIPTION OF PREFERRED EMBODIMENTS

Figure 1:
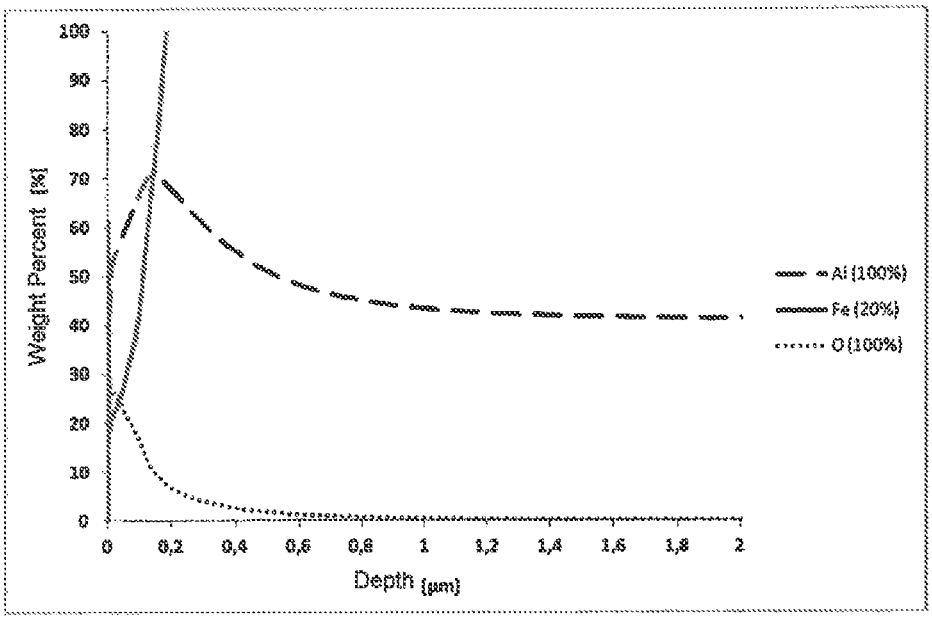
FIG. 1 shows a depth profile for the elements Al, Fe and O after the press-hardening of untreated sheets with an AS coat with a treatment in accordance with the invention.
Figure 2:
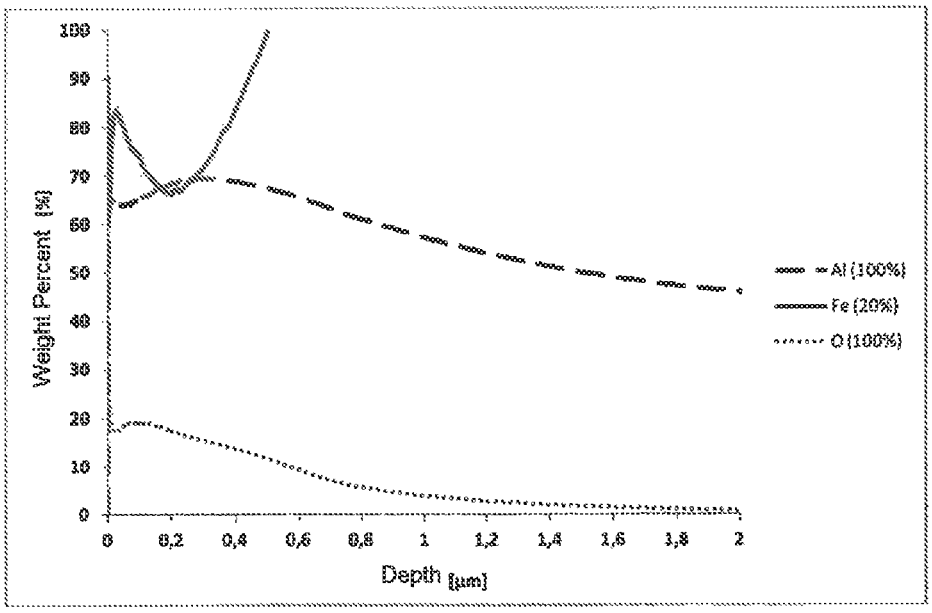
FIG. 2 shows a depth profile for the elements Al, Fe and O after the press-hardening of sheets with an AS coat with a treatment using an iron-containing solution in accordance with the invention.

FIGS. 1 and 2 show the depth profile for the elements Al, Fe and O after the press-hardening of sheets with an AS coat with a treatment in accordance with the invention using an iron-containing solution (FIG. 2) in comparison with an untreated sheet (FIG. 1) with a furnace dwell time of 6 min and a furnace temperature of 950° C. in an air atmosphere. FIG. 2 clearly shows the deeper oxygen input in the sample treated in accordance with the invention, which is indicative of a considerably thicker oxide layer in comparison with the untreated sample. Moreover, the enrichment of iron in the oxide layer can be clearly seen.

The inventive treatment of the surface of the coated steel strip can be effected advantageously in a treatment part located downstream of the process part of a continuously producing hot-dip coating installation or a separate installation e.g. via spray bars with nozzles, in a dipping process and by means of electrolytic deposition or spray electrolysis, in each case also in combination. The separate installation can be e.g. a strip coating or electrolytic strip finishing installation. Alkaline cleaning upstream of the treatment in accordance with the invention and final rinsing of the steel sheet or steel strip provided with an aluminium-based coating advantageously eliminates the (natural) oxide layer which occurs by virtue of atmospheric oxidation and thereby provides a defined starting state for the inventive deposition of metallic species.

The treatment of the surface can be effected in accordance with the invention over the entire strip surface or even only partially or on one or both sides. In the case of the external current-free treatment, it is possible to modify the molar quantity of the deposited metal species by concentrating the charge solution, the temperature thereof, the spray pressure, the shear of the sprayed-on solution relative to the surface of the metal strip to be treated and the volume brought into contact with the surface. In the case of electrolytic deposition, the deposited molar quantity of the metal species is determined by electrolyte composition, flow ratios, temperature, current density and treatment time.

Exemplified Embodiments:

Inventive pre-treatments of the samples are e.g. as follows:

The AS-coated sheet is subjected to a dipping treatment in a metal cation-containing alkaline solution at a temperature of 50° C. for a few seconds. The naturally occurring oxide layer is removed and the iron-containing layer is applied.

Alternatively, the AS-coated sheet is subjected to a dipping treatment in a 20% sodium hydroxide solution for 30 s at room temperature in order to remove the naturally occurring oxide layer. Subsequently, rinsing is effected using completely desalinated water. This is followed by the electrolytic deposition of an iron-containing layer at an electrolyte temperature of 50° C. The deposition is effected for in each case 1 and 10 s respectively at a current density of 23 A/dm$^2$.

Press-Hardening Test Parameters

Furnace temperature for the heat treatment: 950° C.

Atmosphere: ambient air

Furnace dwell time (sheet thickness up to 1.5 mm): 2, 3, 4, 6 min

Then cooling in the cooled flat die to <200° C.

Table 1 shows for the purely wet-chemical pre-treatment of the samples that the thickness of the aluminium oxide layers increases significantly as the coverage of active substance (Fe) and the dwell time in the furnace increase. Without the treatment in accordance with the invention, the layer thickness of the oxide layer is less than 10 nm. In the case of an iron top layer of ca. 7 mg/m$^2$ and dwell time of 2, 3 or 4 min, a significant layer formation is still not achieved. This also applies to an iron top layer of ca. 11 mg/m$^2$ and a dwell time of 2 min,

TABLE 1

Layer formation on the sample surface in dependence upon the iron top layer and furnace dwell time

| | Furnace dwell time/min | | | |
|---|---|---|---|---|
| Top layer of iron/mg/m$^2$ | 2 | 3 | 4 | 6 |
| | Layer thickness of topmost layer/nm | | | |
| ca. 7 | No significant layer formation | | | 170 |
| ca. 11 | | 140 | 200 | 230 |
| ca. 15 | 150 | 220 | 230 | 250 |

Table 2 shows that the pre-treated AS samples which are press-hardened in an air atmosphere and have an iron-containing coating already have a distinct welding area even after short annealing times. Without the treatment hi accordance with the invention, there is no measurable welding area in the case of short annealing times.

TABLE 2

Welding area according to SEP1220-2 in dependence upon the top layer and annealing time

| | Furnace dwell time/min. | | | |
|---|---|---|---|---|
| Top layer of iron/mg/m$^2$ | 2 | 3 | 4 | 6 |
| | Welding area/kA | | | |
| ca. 7 | 2.2 | 2.1 | 2.1 | 1.2 |
| ca. 11 | 2.2 | 2 | 1.7 | 1.7 |
| ca. 15 | 2.5 | 2.1 | 1.7 | 1.6 |

The disbanding at the crack after 12 weeks subjected to the Volkswagen PV1210 corrosion test is less on samples undergoing the treatment in accordance with the invention than on untreated samples, as illustrated in Table 3.

TABLE 3

Disbonding on CD-coated samples after 12 weeks subjected to the Volkswagen PV1210 test in dependence upon the iron top layer and annealing time

| Furnace dwell time/min | Top layer of iron/mg/m$^2$ | Disbonding (UW) at the crack/mm after 12 weeks subjected to the VW PV1210 test |
|---|---|---|
| 2 | ca. 11 | UW < 1 |
| | ca. 15 | UW < 1 |

TABLE 3-continued

| Disbonding on CD-coated samples after 12 weeks subjected to the Volkswagen PV1210 test in dependence upon the iron top layer and annealing time | | |
|---|---|---|
| Furnace dwell time/min | Top layer of iron/mg/m$^2$ | Disbonding (UW) at the crack/mm after 12 weeks subjected to the VW PV1210 test |
| 3 | ca. 7 | UW < 1 |
| | ca. 11 | UW < 1 |
| | ca. 15 | UW < 1 |
| 4 | ca. 7 | UW < 1 |
| | ca. 11 | UW < 1 |
| | ca. 15 | UW < 1 |
| 6 | ca. 7 | UW < 1 |
| | ca. 11 | UW < 1.5 |
| | ca. 15 | UW < 1.5 |
| Without the treatment in accordance with the invention | | |
| 2.5 | 0 | UW > 2 or extensive filiform corrosion |
| 6 | 0 | 1.5 < UW < 2 |

Figure 3:
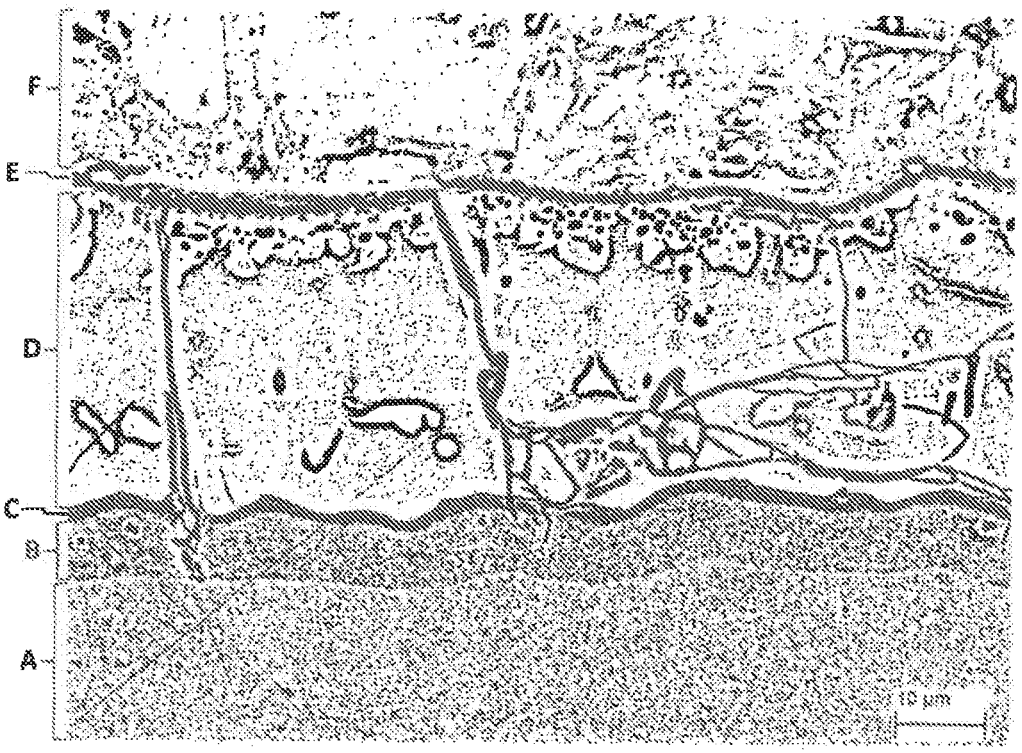
FIG. 3 shows by way of example a cross-section polish on a sheet portion with an AS coating and treatment in accordance with the invention.

FIG. 3 shows by way of example a cross-section polish on a sheet portion with an AS coating and inventive treatment deposited without external current with an iron top layer of ca. 15 mg/m$^2$ after press-hardening. The furnace dwell time was 3 min at a furnace temperature of 950° C. in an air atmosphere.

In this case, the letter A designates the base material; B designates the diffusion zone consisting of a matrix of the base material, into which Al and Si are diffused from the coat; C designates a layer which is rich in Fe—Al phases; D designates the alloying zone, consisting of different Al—Fe, Al—Fe—Si phases; E designates the oxide layer of aluminium oxide and iron oxide; F designates the embedding compound.

The invention claimed is:

1. A method for coating a steel sheet or steel strip, comprising:

applying an aluminium-based coat on the steel sheet or steel strip in a hot-dipping process;

freeing a surface of the aluminium-based coat of a naturally occurring aluminium oxide layer;

depositing transition metals or transition metal compounds, at least one of which includes the chemical element iron, on the freed surface of the coat to thereby form a top layer as a planar deposit with a layer weight, based on said iron, in a range of 7 to 25 mg/m$^2$.

2. The method of claim 1, wherein the layer weight, based on said iron, is 10 to 15 mg/m$^2$.

3. The method of claim 1, wherein the transition metals or transition metal compounds comprise beside the chemical element iron at least one further chemical element selected from the group consisting of titanium, vanadium, chromium, and manganese.

4. The method of claim 1, wherein the chemical element iron is present in a predominant part of the transition metals or the transition metal compounds.

5. The method of claim 1, wherein the transition metals or the transition metal compounds are deposited in the presence of at least one further chemical element selected from the group consisting of cobalt, molybdenum, tungsten, and compounds thereof.

6. The method of claim 1, wherein the transition metals or the transition metal compounds are deposited by chemical deposition.

7. The method of claim 6, wherein the chemical deposition includes spraying, dipping or rolling application.

8. The method of claim 6, further comprising removing atmospherically occurring, natural oxide layer and the chemical deposition in a single process step.

9. The method of claim 8, wherein the removal of the atmospherically occurring, natural oxide layer and the chemical deposition are performed in a continuously operating coating installation which is located downstream of a hot-dip coating installation or is separate from the hot-dip coating installation.

10. The method of claim 1, wherein the transition metals or the transition metal compounds are deposited electrolytically.

11. The method of claim 10, wherein the transition metals or transition metal compounds are applied electrolytically in an aqueous medium as an electrolyte at an electrolyte temperature of 25° C. to 85° C., at current densities between 0.05 and 150 A/dm$^2$.

12. The method of clairn 22, wherein an aluminium oxide layer with mixed oxides from the top layer is formed on the coat with the top layer when exposed to an oxygen atmosphere or when exposed to steam.

13. The method of claim 12, wherein the aluminium oxide layer is formed with the mixed oxides in a furnace at a temperature >750° C. and a furnace dwell time >90 s.

14. The method of claim 12, wherein self-limitation of a layer growth of the aluminium oxide is avoided by formation of the mixed oxides.

15. The method of claim 12, wherein corundum, eskdaite, haematite, karelianite, tistarite, ilmenite, perowskite and/or spinets are formed as the mixed oxides.

16. The method of claim 1, wherein the aluminium-based coat includes aluminium, aluminium-silicon (AS) or aluminium-zinc-silicon (AZ) with optional incorporation of an additional element selected from the group consisting of. magnesium, manganese, titanium, and rare earth.

17. A method for producing a press-hardened component from a steel sheet or steel strip, comprising:

applying an aluminium-based coat on the steel sheet or steel strip in a hot-dipping process, with a surface of the aluminium-based coat being freed of a naturally occurring aluminium oxide layer and transition metals or transition metal compounds, least one of which includes the chemical element iron, being deposited on the freed surface of the coat in order to form a top layer as a planar deposit with a layer weight, based on said iron, in a range of 7 to 25 mg/m$^2$;

heating at least a region of the steel sheet or steel strip to a temperature above Ac3;

forming the steel sheet or steel strip at saki temperature;

cooling the steel sheet or steel strip such as to harden at least a region of the steel sheet or steel strip at a rate which is above a critical cooling rate.

18. The method of claim 17, wherein the steel sheet or steel strip is made of a steel which is hardenable by heat treatment.

19. The method of claim 18, wherein the steel is alloyed with manganese and boron.

20. The method of claim 19, wherein the steel is a 22MnB5 steel.

* * * * *